US009704306B2

(12) United States Patent
Zimmerschied

(10) Patent No.: US 9,704,306 B2
(45) Date of Patent: Jul. 11, 2017

(54) METHOD AND DEVICE FOR DYNAMIC MONITORING OF GAS SENSORS

(71) Applicant: Ralf Zimmerschied, Wiesbaden (DE)

(72) Inventor: Ralf Zimmerschied, Wiesbaden (DE)

(73) Assignee: ROBERT BOSCH GMBH, Stuttgart (DE)

( * ) Notice: Subject to any disclaimer, the term of this patent is extended or adjusted under 35 U.S.C. 154(b) by 54 days.

(21) Appl. No.: 14/377,098

(22) PCT Filed: Jan. 2, 2013

(86) PCT No.: PCT/EP2013/050018

§ 371 (c)(1),
(2) Date: Aug. 6, 2014

(87) PCT Pub. No.: WO2013/117350

PCT Pub. Date: Aug. 15, 2013

(65) Prior Publication Data

US 2014/0358355 A1 Dec. 4, 2014

(30) Foreign Application Priority Data

Feb. 7, 2012 (DE) ..... 10 2012 201 767

(51) Int. Cl.
*G07C 5/08* (2006.01)
*F02D 41/14* (2006.01)

(52) U.S. Cl.
CPC ..... *G07C 5/0808* (2013.01); *F02D 41/1456* (2013.01); *F02D 41/1458* (2013.01);
(Continued)

(58) Field of Classification Search
CPC ..... F02D 41/1495; F01N 2900/0406
See application file for complete search history.

(56) References Cited

U.S. PATENT DOCUMENTS

2010/0211290 A1 8/2010 Kidokoro et al.
2015/0013442 A1 1/2015 Michalske
2015/0039256 A1 2/2015 Michalske

FOREIGN PATENT DOCUMENTS

DE 10 2008 001 121 10/2009
DE 10 2008 001 569 10/2009
(Continued)

OTHER PUBLICATIONS

International Search Report for PCT/EP2013/050018, dated May 2, 2013.

(Continued)

*Primary Examiner* — Jerrah Edwards
(74) *Attorney, Agent, or Firm* — Norton Rose Fulbright US LLP; Gerard Messina

(57) ABSTRACT

In a method for monitoring the dynamics of gas sensors of an internal combustion engine, which gas sensors exhibit a low-pass behavior as a function of geometry, measurement principle, aging, or contamination, a dynamics diagnosis is carried out, upon a change in the gas state variable to be measured, on the basis of a comparison between a modeled and a measured signal. The parameters of the low-pass behavior are determined in direction-dependent fashion by minimizing direction-dependent error signals created by high-pass filtering and logical combination with direction-dependent saturation characteristic curves, the direction-dependent error signals being calculated by comparing the modeled and the measured signal for a rising and a falling signal component.

13 Claims, 1 Drawing Sheet

(52) U.S. Cl.
CPC .. *F02D 41/1495* (2013.01); *F02D 2041/1423* (2013.01); *F02D 2041/1431* (2013.01); *F02D 2041/1432* (2013.01); *F02D 2041/1433* (2013.01)

(56) References Cited

FOREIGN PATENT DOCUMENTS

| | | | |
|---|---|---|---|
| DE | 10 2008 001213 | | 10/2009 |
| DE | 10 2008 026741 | | 12/2009 |
| DE | 10 2008 040737 | | 1/2010 |
| DE | 102012200032 | A1 | 7/2013 |
| JP | 2006118428 | A | 5/2006 |
| JP | 2010190089 | A | 9/2010 |
| WO | 2013029878 | A1 | 3/2013 |

OTHER PUBLICATIONS

Isermann, Rolf "Identifikation dynamischer Systeme" (Identification of Dynamic Systems), vol. 1 and 2, Springer—Verlag Berlin Heidelberg (1992), ISBN-13:978-3642846809 and ISBN-13: 978-3642847707.
Nelles, Oliver "Nonlinear System Identificaiton", Springer—Verlag Berlin Heidelberg (2001), ISBN 3-540-67369-5.
Ljung, Lennart "System Identification Theory for the User", Sweden, (1999) Prentice Hall PTR.

METHOD AND DEVICE FOR DYNAMIC MONITORING OF GAS SENSORS

BACKGROUND OF THE INVENTION

1. Field of the Invention

The present invention relates to a method and an apparatus for monitoring the dynamics of gas sensors of an internal combustion engine which are disposed, for example, as gas probes in the exhaust gas duct of an internal combustion engine as part of an exhaust gas monitoring and abatement system or as gas concentration sensors in an intake air passage of the internal combustion engine, the gas sensor exhibiting a low-pass behavior as a function of geometry, measurement principle, aging, or contamination, a dynamics diagnosis being carried out, upon a change in the gas state variable to be measured, on the basis of a comparison between a modeled and a measured signal, and the measured signal being an actual value of an output signal of the gas sensor and the modeled signal being a model value.

2. Description of the Related Art

In order to reduce emissions in passenger cars having Otto-cycle engines it is usual to use, as exhaust emission control systems, three-way catalytic converters that convert exhaust gas adequately only when the air/fuel ratio $\lambda$ is regulated with high precision. For that purpose, the air/fuel ratio $\lambda$ is measured using an exhaust gas probe upstream from the exhaust emission control system. The ability of an exhaust emission control system of this kind to store oxygen is exploited in order to accept oxygen in lean phases and emit it again in rich phases. The result of this is that oxidizable pollutant gas components of the exhaust gas can be converted. An exhaust gas probe downstream from the exhaust emission control system serves to monitor the oxygen storage capacity of the exhaust emission control system. The oxygen storage capacity must be monitored in the context of onboard diagnosis (OBD), since it represents an indication of the conversion capacity of the exhaust emission control system. In order to determine the oxygen storage capacity, either the exhaust emission control system is firstly loaded with oxygen in a lean phase and then purged in a rich phase with a known lambda value in the exhaust gas in consideration of the quantity of exhaust gas passing through, or the exhaust emission control system is firstly purged of oxygen in a rich phase and then filled in a lean phase with a known lambda value in the exhaust gas in consideration of the quantity of exhaust gas passing through. The lean phase is terminated when the exhaust gas probe downstream from the exhaust emission control system detects the oxygen that can no longer be stored by the exhaust emission control system. Likewise, a rich phase is terminated when the exhaust gas probe detects the passage of rich exhaust gas. The oxygen storage capacity of the exhaust emission control system corresponds to the quantity of reducing agent delivered for purging during the rich phase, or to the quantity of oxygen delivered for filling during the lean phase. The exact quantities are calculated from the signal of the upstream exhaust gas probe and from the exhaust gas mass flow ascertained from other signals.

If the dynamics of the upstream gas probe decrease, for example due to contamination or aging, the air/fuel ratio can then no longer be regulated with the necessary precision, so that the conversion performance of the exhaust emission control system declines. Deviations can also occur in the diagnosis of the exhaust emission control system, and can cause an exhaust emission control system that is in fact operating correctly to be wrongly evaluated as non-functional. Legislation requires a diagnosis of probe properties during driving operation in order to ensure that the required air/fuel ratio can continue to be established with sufficient accuracy, that emissions do not exceed permissible limits, and that the exhaust emission control system is being correctly monitored. OBDII provisions require that lambda probes and other exhaust gas probes be monitored not only in terms of their electrical functionality, but also with regard to their response behavior; in other words, a deterioration in probe dynamics, which can become evident due to an increased time constant and/or a dead time, must be detected. Dead times and delay times between a change in exhaust gas composition and the detection thereof must be tested onboard as to whether they are still permissible for user functions, i.e. for control, regulation, and monitoring functions that utilize the probe signal. The dead time from a change in mixture until the signal edge, and a specific rise time, e.g. from 0% to 63% or from 30% to 60% of a signal swing, are typically used as parameters for the dynamic properties of exhaust gas sensors. The dead time also encompasses the gas transit time from the engine outlet to the probe, and therefore changes in particular when the sensor installation location is manipulated.

The gas sensors or gas concentration sensors used in diesel engines are broadband lambda probes and, in connection with SCR catalytic converters, also $NO_x$ sensors. The latter also additionally supply an $O_2$ signal. The $O_2$ signal of a broadband lambda probe or $NO_x$ sensor is used in a diesel engine not only for the operation of exhaust gas post-processing devices, but also for emissions reduction within the engine. The measured $O_2$ concentration in the exhaust gas, or the measured lambda signal, is used to establish the air/fuel mixture accurately in dynamic fashion, and thus to minimize the variability of the raw emissions. In diesel engines having an $NO_x$ storage catalytic converter (NSC), a broadband lambda probe is required respectively before and after the catalytic converter for reliable representation of the rich mode for regeneration. Emissions reduction inside the engine and NSC operation likewise impose certain minimum requirements in terms of the dynamic properties of the $O_2$ probe. Nowadays the rise time of the $O_2$ signal is monitored at the transition from load to coast, i.e. upon an increase from a specific percentage below the normal $O_2$ content of air to 21%. If the sensor signal has not reached a specific intermediate value after a maximum time, this is interpreted as a dead-time fault. In diesel engines having an $NO_x$ storage catalytic converter (NSC), the response behavior of the lambda probes before and after the catalytic converter is also usually compared.

It is to be expected, for future vehicle generations and model years, that monitoring of the sensor dynamics in a context of decreasing $O_2$ concentration will also be required. In addition, with hybrid vehicles there will in the future be no coasting phases and therefore no phases with a constant $O_2$ concentration of 21%.

Initial approaches to solutions to these additional requirements are active monitoring in published German patent application document DE 10 2008 001 121 A1, and the observer-based method in published German patent application document DE 10 2008 040 737 A1.

Published German patent application document DE 10 2008 040 737 A1 discloses a method for monitoring dynamic properties of a broadband lambda probe, in which a measured lambda signal that corresponds to an oxygen concentration in the exhaust gas of an internal combustion engine is determined by way of the broadband lambda probe, in which the internal combustion engine has associated with it an observer that generates a modeled lambda signal from input variables, and in which from the difference between the modeled lambda signal and the measured lambda signal, or from the difference between a signal derived from the modeled lambda signal and a signal derived from the measured lambda signal, an estimation error signal is created as input variable of a controller in the observer upstream from a model. Provision is made here that an indication of the dynamic properties, characterized by a dead time and reaction time, of the broadband lambda probe is determined from an evaluation of the estimation error signal or of a variable derived therefrom, and that the indication of the dynamic properties is compared with defined limit values in order to assess the extent to which the dynamic properties of the broadband lambda probe are sufficient for an intended operating mode of the internal combustion engine.

Published German patent application document DE 10 2008 001 569 A1 furthermore describes a method and an apparatus for online adaptation of an LSU dynamic model. The document relates concretely to a method and an apparatus for adapting a dynamic model of an exhaust gas probe which is a constituent of an exhaust gas duct of an internal combustion engine and with which a lambda value for regulating an air/fuel composition is determined, a simulated lambda value being calculated in a control device and in a diagnosis device of the internal combustion engine concurrently therewith, and both the simulated and the measured lambda value being utilized by a user function. Provision is made here that during vehicle operation, a step behavior of the exhaust gas probe is determined by evaluating a signal change upon excitation of the system, and on the basis of these results the dynamics model of the exhaust gas probe is adapted.

Known functions for monitoring the dynamics of broadband lambda probes are employed for identification of the sensor properties. The requirements for other gas concentration signals of exhaust gas sensors, e.g. for an $NO_x$ signal, are comparable to those for $O_2$ signals and $O_2$ sensors. It is therefore to be assumed that there are similarities between the monitoring functions.

The method according to published German patent application document DE 10 2008 001 121 A1 involves active monitoring. It contains an excitation by way of a test injection, which increases not only fuel consumption but also emissions. The method according to published German patent application document DE 10 2008 040 737 A1 operates passively, but requires a so-called "observer" that is complex in terms of application. In addition, both methods are directed primarily toward the detection of larger changes in dead time.

A known method for detecting dynamics uses step-like adjustments to the air/fuel ratio, on the basis of which the dynamics of the probe are evaluated as a function of direction by calculating the ratio of the areas under the step response of the measured air/fuel ratio and of a simulated one. No detection or differentiation of time-constant errors and/or dead-time errors is possible; the procedure is entirely heuristic.

A first-order filter having a time constant T and a gain K=1, as well as a dead-time model having a dead time $T_t$, are used to model the air/fuel ratio in the control unit. The first-order filter can accordingly be described as follows:

$$G_{(s)}=K\exp(-T_t s)/(Ts+1) \quad (1).$$

In order to reduce the negative effects of an asymmetrical time constant and/or dead time, for example an oscillating control system, when the time constant or dead time is known to be asymmetrical the measured air/fuel ratio is symmetrized in the control unit using a so-called "symmetrization" filter. For this, the undelayed and/or filtered edge of the signal is artificially delayed with an additional dead time and/or filtered with an additional filter in the control unit; the dead time and/or time constant used corresponds to the diagnosed asymmetrical dead time $T^+_t$ and/or time constant $T^+$, and the direction of the signal (rich to lean or lean to rich) is determined on the basis of a filtered derivative of the measured lambda signal.

For a system having a slowed-down probe, it is therefore assumed that the nominal model $G_{(s)}$ is supplemented with a further first-order filter as well as a dead-time model:

$$G^+_{(s)}=G_{(s)}K^+\exp(-T^+_t s)/(T^+ s+1) \quad (2).$$

Once the symmetrization filter has been applied, the entire signal (rich to lean and lean to rich) is symmetrically delayed using two dead times and/or two time constants. This additional delay can be accounted for in the controller by adapting the controller to the greater dead times and/or time constants while retaining its structure, or the increase in the order of the model can even be taken into account by increasing the order of the controller.

A further method, which is known from an as yet unpublished application document of the Applicant, likewise uses a step-like adjustment of the air/fuel ratio but evaluates the slope of the step response and explicitly calculates therefrom a dead time and time constant.

Also known from the literature (Isermann: "Identifikation dynamischer Systeme" [Identification of dynamic systems], Vols. 1 and 2; Nelles: "System Identification"; Ljung: "System Identification—Theory for the User") are so-called online identification methods with which dead times, time constants, and gain factors, or in general the parameters of dynamic systems, can be determined during normal driving operation. A prerequisite for this is ongoing excitation of the system, on the basis of which the online identification system determines the relevant dead times using recursive optimization methods.

These methods take into account only symmetrical dead times and time constants, however. High-pass filters can be used in this context to suppress offsets or other low-frequency interference signals (Isermann: "Identifikation dynamischer Systeme, Vol. 2) so that the offset does not need to be explicitly estimated.

An online identification method for asymmetrical dead times and time constants is described in an as yet unpublished application document of the Applicant which is based on a so-called "symmetrization" filter. Methods that determine direction-dependent dynamic parameters such as time constants, but not dead times, are also known from the literature.

An as yet unpublished parallel application of the Applicant describes a method for the identification of asymmetrical dead times which is based on cross-correlation or cross-energy, and on the use of high-pass-filtered signals in combination with saturation characteristic curves.

In order to allow asymmetrical time constants also to be identified, this method can be combined with a method for the identification of time constants based on signal energy, which method is described in a further parallel application of the Applicant; the results of these two methods depend on one another, since a time-constant error can also be interpreted as a dead-time error and vice versa. The influence of gain also remains unaccounted for, so that a gain error influences the identification of the time constants. These methods moreover operate iteratively, so that either multiple measurements are necessary or the measured values must be buffered.

All the methods can work both with the air/fuel ratio and with the inverse air/fuel ratio.

In order to improve and enhance the robustness of dynamics monitoring for gas sensors, in particular exhaust gas probes, which can be designed as continuous lambda probes, the object of the invention is to make available a corresponding method that on the one hand operates continuously and on the other hand identifies, in particular, asymmetrical parameters of these dynamic systems.

A further object of the invention is to make available a corresponding apparatus for carrying out the method.

BRIEF SUMMARY OF THE INVENTION

The object relating to the method is achieved in that the parameters of the low-pass behavior are determined in direction-dependent fashion by minimizing direction-dependent error signals that are created by high-pass filtering and logical combination with direction-dependent saturation characteristic curves, the direction-dependent error signals being calculated by comparing the modeled and the measured signal for a rising and a falling signal component. With this method it is possible to determine, in particular, asymmetrical parameters of the dynamic behavior, separated as to rising and falling signal components. High-pass filtering of the signals allows any possible offset to be removed from the signals, so that the offset does not need to be explicitly estimated in the course of optimization. Minimization of the direction-dependent error signals is accomplished by applying methods known from the literature, as mentioned previously.

Minimization is advantageously performed by adapting the parameters in a model for the gas sensor or in separate error models, separately for the rising and for the falling signal component. If the adapted parameters of the model and/or the error models correspond to those of the real gas sensor, the result is then a minimal error signal, whereupon firstly adaptation is completed and a set of parameters is ascertained, separately for rising and falling signals, as a result of the dynamics diagnosis. Completion of adaptation can be defined, for example, by way of corresponding threshold values for the changes in the parameters.

A change in the gas state variable to be measured can occur by way of an excitation of the internal combustion engine. With this method, changes in terms of dynamics in gas sensors can be verified and quantified. "Gas sensors" for purposes of the invention are sensors that can measure the states of a gas and detect changes. The state of the gas can be described by a temperature of the gas, a gas pressure, a gas mass flow, and/or a concentration of a specific gas component, e.g. an oxygen content or $NO_x$ content. Gas sensors exhibit a typical low-pass behavior that depends inter alia on the geometry of their configuration. The response behavior of such sensors can moreover change as a result of age or external influences (e.g. due to carbon accumulation in diesel engines).

The method furthermore provides that any excitations having a sufficiently large signal-to-noise ratio, in which the gas state variable to be measured is varied, are used for identification of the direction-dependent parameters.

In a preferred variant of the method, what is varied as a gas state variable for diagnosing the dynamics of the gas sensor is an air/fuel ratio of an air/fuel mixture delivered to the internal combustion engine, the variation being accomplished by way of a positive excitation that periodically varies the air/fuel ratio by way of small step-like changes in an injection quantity, or by way of an oscillating control circuit. Instead of a one-time evaluation of a large step, this makes possible continuous evaluation of many small steps, or utilization of an oscillation of the control circuit. The resulting advantage is that the large steps in the air/fuel ratio that are otherwise required can be omitted, thereby avoiding the increase in fuel consumption and emissions associated with the large steps. If the identification is carried out only in the case of an oscillating control circuit, a strong excitation with a good signal-to-noise ratio often additionally results, so that on the one hand the quality and speed of the identification are improved, and on the other hand an identification is very useful precisely at that point in time, since the control circuit has possibly ended up oscillating specifically because of a change in sensor dynamics. In this case it is therefore particularly useful to carry out an identification of the sensor dynamics. A further advantage is the increase in robustness, since as a result of statistical averaging effects, an evaluation of many small steps or of the controller oscillation reacts less sensitively to interference than evaluation of only one large step. In addition, excitation using one step is not a requirement, but instead it is possible to work with any excitation signals as long as the signal-to-noise ratio is sufficient. The proposed method moreover completely takes into account the influence of the control system, by the fact that the adjusting action is the input signal for online identification. It is furthermore also possible to estimate a system gain, so that a change in system gain has no influence on identification of the dead time and time constant.

Direction-dependent parameters that can be evaluated with the method are a time constant T, a dead time $T_t$, a gain factor K, in each case separately for a rising and falling signal component, or any combinations of these parameters.

In a variant of the method, provision is made that the direction-dependent error signals are calculated as difference values or squares of said difference values, the difference value being determined for a rising signal from a high-pass-filtered modeled signal for a rising value and a high-pass-filtered measured signal for a rising value, and the difference value for a falling signal being determined from a high-pass-filtered modeled signal for a falling value and a high-pass-filtered measured signal for a falling value, which simplifies adaptation of the parameters. The square of the respective difference values corresponds to a quality criterion and is proportional to a signal energy of these filtered signal components.

If the identification of these dynamic parameters is carried out online with the aid of recursive, continuously operating optimization methods, the memory resource requirements are low because measured values do not need to be buffered. In principle, the optimization methods used can be methods known from the literature that permit both continuous and time-discrete calculation. A continuously proceeding identification of the parameters offers advantages in terms of accuracy, however, especially in the determination of dead times, since in discrete time intervals the dead time can assume only multiples of a sampling time, which would make optimization difficult. Methods in continuous time are moreover numerically more robust in terms of selection of the sampling time in relation to the identified dead times or time constants which, in this application instance, can range from 0 to a multiple of the sampling time.

If previous knowledge is available, it is furthermore possible that what needs to be estimated is not all the parameters (dead time, time constant, and gain), but instead any combinations of these three parameters. If it is known a priori, for example, that dead-time errors or time-constant errors always occur only in isolation, and if the gain is also constant and known, identification of the dead time and time constant can then also occur separately, and an identification of gain can be omitted. Because a dead-time error or time-constant error also has an influence on the identification of the respective other variable, subsequently to identification a decision must be made as to which error has in fact occurred. This can be done by comparing the residual errors from the identification of individual parameters and selecting the error pattern having the lesser residual error as the actual error pattern. This procedure is possible only because the same method is utilized for the separate identification of dead time and time constant, so that the residual errors are comparable. The residual errors can be described, for example, by filtering the quality criterion used for optimization.

A further advantage is obtained by expanding the method to include operating-point-dependent identification. Here provision is made that after each adaptation step, the adapted parameters are programmed into operating-point-dependent characteristic curves or multi-dimensional characteristics diagrams. This is made possible by recursive optimization that supplies re-adapted parameter sets for each adaptation step.

Optimization can be carried out, for example, using gradient methods such as the "steepest slope" method, or using the Gauss-Newton method, these also being available in recursive variants for online optimization. The gradients are calculated analytically by filtration and dead-time delay of the modeled and measured signals. In an expansion of the method, provision can be made that in the context of optimization, an adaptation rate is defined separately, by way of a learning gain, for each of the parameters to be optimized. In some methods, for example in the Gauss-Newton method, the learning gain arises adaptively on the basis of a covariance matrix, with the result that faster adaptation is achieved. A recursive "forgetting factor," which in this case represents the only application parameter, can be used here. This forgetting factor can likewise be configured variably as a function of the current excitation, so as thereby to alleviate the conflict in objectives between fast excitation and noise suppression. This also makes it possible, inter alia, in the case of a small excitation to slow down or entirely stop adaptation, or in fact not to start it at all. The latter is useful in particular when, as a result of sensor slowing, only an oscillating control circuit serves as excitation.

The inventive diagnosis method can be employed particularly advantageously with gas sensors that are used, as gas pressure sensors, gas temperature sensors, gas mass flow sensors, or gas concentration sensors, as exhaust gas probes in the exhaust gas duct of the internal combustion engine as part of an exhaust gas monitoring and abatement system, or in an intake air passage of the internal combustion engine, for example in the intake manifold, in order to sense gas state variables or concentrations. Because of the requirements mentioned previously, these emissions-relevant gas sensors must be monitored in terms of their dynamics and general function. For example, the response behavior of a gas pressure sensor can be monitored and a decline in dynamics can be detected if, for example, the connection between the gas pressure sensor and an intake manifold is clogged or buckled. Gas temperature sensors or gas mass flow sensors can be embodied, for example, as hot film air mass sensors within an intake air passage of the internal combustion engine in which a loss of dynamics as a result of contamination is apparent. The method according to the present invention, as described above in its variant methods, can advantageously be utilized if a suitable model can be described for the signals of such sensors.

Appropriate gas sensors are, in particular, exhaust gas probes in the form of broadband lambda probes (LSU probes) or $NO_x$ sensors, with which an oxygen content in a gas mixture can be determined. In the case of an exhaust gas probe embodied as a broadband lambda probe or continuous lambda probe, for diagnosis preferably the measured oxygen concentration is compared, in accordance with the above-described variant methods, with a modeled oxygen concentration. Alternatively, a reciprocal lambda value can be used for this comparison, since it is approximately proportional to the oxygen concentration. Also suitable are electrical variables that are proportional to the oxygen concentration, i.e. a voltage or a current in the sensor or in the associated circuit. The model signal employed for comparison must then be correspondingly converted. For a nitrogen oxide sensor, the output signal of the nitrogen oxide sensor is evaluated as an actual value, the model value being determined from a modeled $NO_x$ value. This diagnosis can therefore be applied particularly advantageous in Otto-cycle engines or in lean-burn engines whose exhaust emission control system has a catalytic converter and/or devices for nitrogen oxide reduction. For gas sensors that are installed after an exhaust emission control system, the influence of exhaust gas emission control on the gas concentration of interest in the model must be taken into account. It is alternatively conceivable to carry out the diagnosis only in phases in which exhaust emission control has no influence on the gas concentration of interest.

The method as described above in its variants not only can be used for first-order systems, but also can be advantageously applied to any direction-dependent systems of any order, with or without dead time, in which the identification of asymmetrical dynamic parameters is important.

The object relating to the apparatus is achieved in that in order to carry out the method according to the present invention as described above, a diagnosis unit is provided which has high-pass filters, subtractors, and memory units for direction-dependent saturation characteristic curves for determination of the direction-dependent error values. The functionality of the diagnosis unit can be embodied at least partly on a software basis, and it can be provided as a separate unit or as part of a higher-level engine control system.

In a variant embodiment, provision can furthermore be made that the diagnosis unit has memory units for operating-point-dependent characteristic curves or characteristics diagrams for carrying out an operating-point-dependent identification of the parameters.

DETAILED DESCRIPTION OF THE INVENTION

Figure 1:
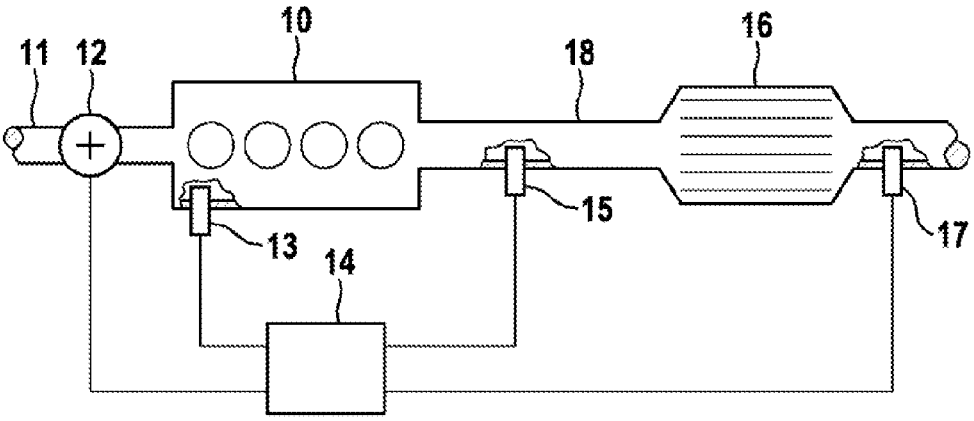
FIG. 1 schematically depicts the technical environment in which the method according to the present invention can be applied.

FIG. 1 schematically shows, using the example of an Otto-cycle engine, the technical environment in which the method according to the present invention for diagnosis of an exhaust gas probe 15 can be used. Air is delivered via an air intake 11 to an internal combustion engine 10, and its mass is identified using an air mass sensor 12. Air mass sensor 12 can be embodied as a hot film air mass sensor. The exhaust gas of internal combustion engine 10 is discharged through an exhaust gas duct 18, an exhaust emission control system 16 being provided behind internal combustion engine 10 in the flow direction of the exhaust gas. Exhaust emission control system 16 usually encompasses at least one catalytic converter.

An engine control system 14 is provided in order to control internal combustion engine 10, which system on the one hand delivers fuel to internal combustion engine 10 via a fuel metering system 13 and on the other hand has delivered to it the signals of air mass sensor 12 and of exhaust gas probe 15 disposed in exhaust gas duct 18, and of an exhaust gas probe 17 disposed in exhaust gas duct 18. In the example shown, exhaust gas probe 15 determines an actual lambda value of a fuel/air mixture delivered to internal combustion engine 10. It can be embodied as a broadband lambda probe or a continuous lambda probe. Exhaust gas probe 17 determines the exhaust gas composition after exhaust emission control system 16. Exhaust gas probe 17 can be embodied as a "step" probe or binary probe.

For dynamics diagnosis of exhaust gas probe 15, the air/fuel ratio (AFR) in the combustion chamber is usually adjusted in step fashion, and within a certain time span after the step the absolute value of the maximum slope of the measured air/fuel ratio is determined. In accordance with the invention a continuously operating method is proposed especially for detecting asymmetrical dead times and time constants, which method does not evaluate individual large steps in the air/fuel ratio but rather utilizes any excitation having a sufficiently large signal-to-noise ratio. This can be, for example, the positive excitation that is generally present and that periodically varies the air/fuel ratio by way of small step-like changes in injection, or an oscillating control circuit.

For detection of these asymmetrical time constants and dead times, the methods of online identification known from the literature, or further such methods described in parallel applications of the Applicant, are expanded in such a way that not only is a symmetrical time constant and dead time identified jointly for a rising and falling signal, but a time constant and a dead time are respectively identified separately for a rising and falling signal.

Figure 2:
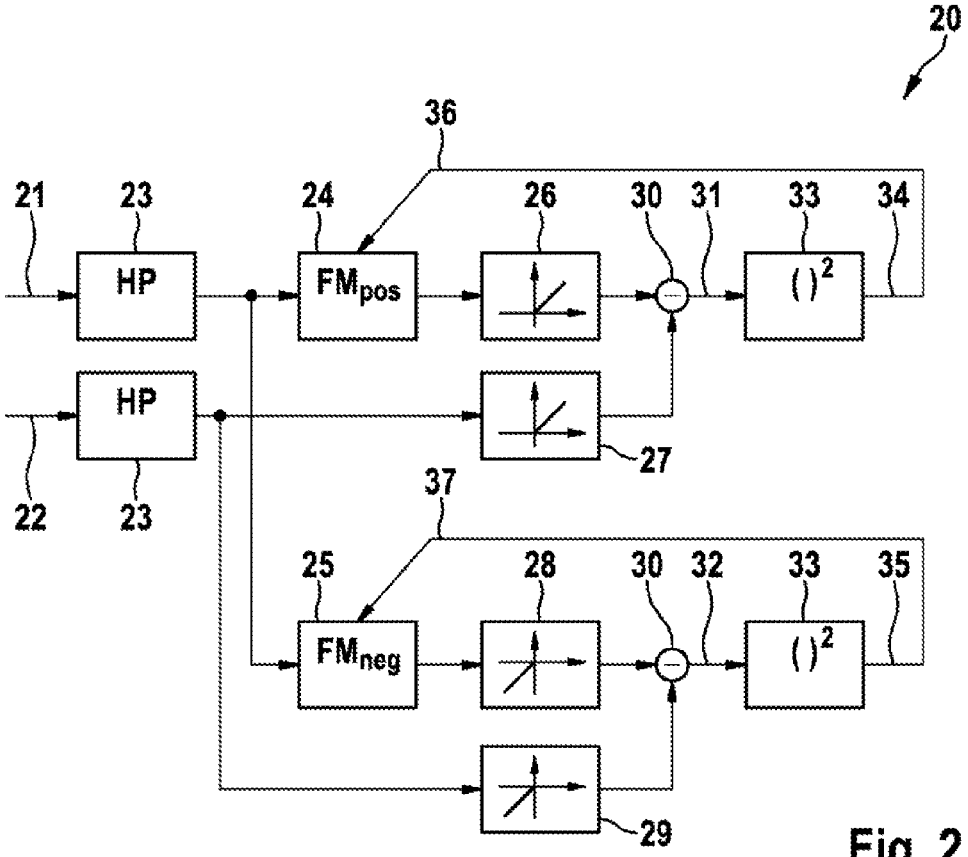
FIG. 2 is a block diagram of a dynamics diagnosis function in accordance with the invention.

FIG. 2 shows a block diagram 20 indicating the functionality of the method in a preferred variant of the method.

Firstly the model input having a lambda value 21 $\lambda_{mod}$ modeled in accordance with a nominal model, and the process output to be identified, having a measured lambda value $\lambda_{meas}$, are filtered with an identical high-pass filter 23.

This removes a possible offset from the signals, so that the offset does not need to be explicitly estimated in the course of optimization. The high-pass filtration furthermore produces a separation into a rising and a falling signal, by the fact that the high-pass-filtered signals are logically combined with saturation characteristic curves 26, 27, 28, 29 and a separation of rising and falling signals thus takes place, a saturation characteristic curve 26 being provided for a rising model signal component, a saturation characteristic curve 27 for a rising measured signal component, a saturation characteristic curve 28 for a falling modeled signal component, and a saturation characteristic curve 29 for a falling measured signal component. This combination of high-pass filter 23 and saturation characteristic curves 26, 27, 28, 29 makes possible a distinction between signal components having a rising (positive) and falling (negative) edge, and thus the identification of asymmetrical time constants and dead times. The saturation elements can be defined as follows:

$$y_{sat,pos}=x \text{ for } x\geq 0 \tag{3a}$$

$$y_{sat,pos}=0 \text{ for } x<0 \tag{3b}$$

for saturation characteristic curves 26, 27

$$y_{sat,neg}=0 \text{ for } x>0 \tag{3c}$$

$$y_{sat,neg}=x \text{ for } x\leq 0 \tag{3d}$$

for saturation characteristic curves 28, 29.

The result of this high-pass filtering and subsequent signal separation by way of saturation characteristic curves 26, 27, 28, 29 for the modeled and measured lambda value 21, 22 is that ultimately four signals are available:

i. a high-pass-filtered modeled lambda value for a rising lambda value $\lambda_{mod,pos}$,
ii. a high-pass-filtered modeled lambda value for a falling lambda value $\lambda_{mod,neg}$,
iii. a high-pass-filtered measured lambda value for a rising lambda value $\lambda_{meas,pos}$,
iv. a high-pass-filtered measured lambda value for a falling lambda value $\lambda_{meas,neg}$, Using these signals, a separate identification of gain K, dead time $T_t$, and/or time constant T is then performed for rising and falling signals. Methods known from the literature are utilized in this context in continuous or discrete time; continuous methods have the advantages recited above.

In a preferred variant, the identification is therefore accomplished online with the aid of recursive, continuously operating optimization methods, so that no storage of the signals is necessary.

Identification is based on a comparison of the modeled and measured signal, separately for rising and falling signal components; using subtractor 30, a respective difference is formed and that difference is minimized, the gain K, dead time $T_t$, and/or the time constant being the parameters to be optimized. These differences are defined, as error values for a rising signal and a falling signal 31, 32 ($e_{pos}$, $e_{neg}$), as follows:

$$e_{pos}=\lambda_{meas,pos}-\lambda_{mod,pos} \tag{4a}$$

$$e_{neg}=\lambda_{meas,neg}-\lambda_{mod,neg} \tag{4b}$$

and are then respectively calculated with a squaring unit 33 to yield an error indication for the rising signal and for the falling signal 34, 35 ($E_{pos}$, $E_{neg}$), as follows:

$$E_{pos}=(e_{pos})^2 \tag{5a}$$

$$E_{neg}=(e_{neg})^2 \tag{5b}$$

This squared error value (error indication) represents a quality criterion on the basis of which the lambda model can be adapted, directly and/or additionally via error models 24, 25, for the rising and the falling signal ($FM_{pos}$, $FM_{neg}$) by way of a parameter adaptation for the rising and falling signal 36, 37, where the respective error model 24, 25 can be provided in the function sequence after high-pass filter 23 as shown in FIG. 2, or also before high-pass filter 23. An adaptation of the time constant $T_{pos}$, dead time $T_{tpos}$, and/or gain $K_{pos}$ is provided for in the parameter adaptation for the rising signal 36. The parameter adaptation for the falling signal 37 provides for adaptation of the time constant $T_{neg}$, dead time $T_{tneg}$, and/or gain $K_{neg}$.

Optimization can be carried out, for example, using gradient methods such as the "steepest slope" method, or using the Gauss-Newton method, these also being available in recursive variants for online optimization. The gradients are calculated analytically by filtration and dead-time delay of the modeled and measured signals.

It is furthermore possible in the context of optimization to define the adaptation rate separately, by way of learning gains, for each of the parameters to be optimized.

Because this method carries out, at every time interval, an adaptation of the parameters to be optimized, the adapted parameters can furthermore be programmed into operating-point-dependent characteristic curves or multi-dimensional characteristics diagrams at the current point in time, so that identification as a function of operating point is also possible. For this, at each time interval the current parameters of the error model 24, 25 ($FM_{pos}$, $FM_{neg}$) are read out of the characteristic curves or characteristics diagrams on an operating-point-dependent basis, the adaptation is carried out based on those parameters, and the re-adapted values are programmed back into the characteristic curves or characteristics diagrams on an operating-point-dependent basis.

In principle, the invention is not limited to systems whose dynamic behavior, as mentioned previously, can be described by a first-order low-pass. This identification method is likewise also applicable to systems of any order, with and without dead time.

What is claimed is:

1. A method for monitoring the dynamics of a gas sensor of an internal combustion engine, wherein the gas sensor exhibits a low-pass behavior as a function of at least one of geometry, measurement principle, aging, and contamination, the method comprising:

performing a dynamics diagnosis upon a change in a gas state variable measured by the gas sensor, on the basis of a comparison between a modeled and a measured signal;

wherein the measured signal is an actual value of an output signal of the gas sensor and the modeled signal is a model value, and wherein the parameters of the low-pass behavior are determined in direction-dependent fashion by minimizing direction-dependent error signals which are created by high-pass filtering and logical combination with direction-dependent saturation characteristic curves, the direction-dependent error signals being calculated by comparing the modeled and the measured signal for a rising and a falling signal component, wherein the gas state variable for diagnosing the dynamics of the gas sensor is an air/fuel ratio of an air/fuel mixture delivered to the internal combustion engine, and wherein the air/fuel ratio is varied by a positive excitation that periodically varies the air/fuel ratio one of (i) by way of small step-like changes in an injection quantity, or (ii) by way of an oscillating control circuit.

2. The method as recited in claim 1, wherein minimization is carried out by adapting the parameters of the low-pass behavior in one of (i) a model for the gas sensor or (ii) in separate error models for the rising signal component and for the falling signal component.

3. The method as recited in claim 1, wherein excitations having a sufficiently large signal-to-noise ratio, in which the gas state variable to be measured is varied, are used for identification of the direction-dependent parameters.

4. The method as recited in claim 1, wherein a time constant, a dead time, and a gain factor are evaluated as direction-dependent parameters, in each case separately for a rising and falling signal component.

5. The method as recited in claim 1, wherein the direction-dependent error signals are calculated as difference values or squares of said difference values, the difference value being determined for a rising signal from a high-pass-filtered modeled signal for a rising value and a high-pass-filtered measured signal for a rising value, and the difference value for a falling signal being determined from a high-pass-filtered modeled signal for a falling value and a high-pass-filtered measured signal for a falling value.

6. The method as recited in claim 1, wherein the determination of the parameters of the low-pass behavior is carried out online with the aid of recursive, continuously operating optimization methods.

7. The method as recited in claim 1, wherein residual errors from the determination of the individual parameters are compared, and the error pattern having the lesser residual error is selected as the actual error pattern.

8. The method as recited in claim 6, wherein after each adaptation step, the adapted parameters are programmed into one of operating-point-dependent characteristic curves or multi-dimensional characteristics diagrams.

9. The method as recited in claim 6, wherein in the context of optimization, an adaptation rate is defined separately, by way of a learning gain, for each of the parameters to be optimized.

10. The method as recited in claim 6, wherein the monitored gas sensor is one of a gas pressure sensor, a gas temperature sensor, a gas mass flow sensor, or a gas concentration sensor used one of (i) as an exhaust gas probe in an exhaust gas duct of the internal combustion engine as part of an exhaust gas monitoring and abatement system, or (ii) in an intake air passage of the internal combustion engine.

11. The method as recited in claim 10, wherein the monitored gas sensor is an exhaust gas probe in the form of one of a broadband lambda probe or $NO_x$ sensor with which an oxygen content in a gas mixture is determined.

12. An apparatus for monitoring the dynamics of a gas sensor used one of (i) in an exhaust gas duct of an internal combustion engine as part of an exhaust gas monitoring and abatement system, or (ii) in an intake air passage of the internal combustion engine, the gas sensor exhibiting a low-pass behavior as a function of at least one of geometry, measurement principle, aging, and contamination, the apparatus comprising:

a diagnosis unit performing a dynamics diagnosis upon a change in a gas state variable measured by the gas sensor, on the basis of a comparison between a modeled and a measured signal, wherein the measured signal is an actual value of an output signal of the gas sensor and the modeled signal is a model value, and wherein the diagnosis unit has at least one high-pass filter, at least one subtractor, and memory units storing direction-dependent saturation characteristic curves, and wherein the parameters of the low-pass behavior are determined in direction-dependent fashion by minimizing direction-dependent error signals which are created by high-pass filtering and logical combination with direction-dependent saturation characteristic curves, the direction-dependent error signals being calculated by comparing the modeled and the measured signal for a rising and a falling signal component, wherein the gas state variable for diagnosing the dynamics of the gas sensor is an air/fuel ratio of an air/fuel mixture delivered to the internal combustion engine, and wherein the air/fuel ratio is varied by a positive excitation that periodically varies the air/fuel ratio one of (i) by way of small step-like changes in an injection quantity, or (ii) by way of an oscillating control circuit.

13. The apparatus as recited in claim 12, wherein the diagnosis unit has memory units storing operating-point-dependent characteristic curves or characteristics diagrams.

* * * * *